US008365320B1

(12) United States Patent
Lordahl et al.

(10) Patent No.: US 8,365,320 B1
(45) Date of Patent: Feb. 5, 2013

(54) UNIVERSAL FLUSH VALVE SYSTEM

(75) Inventors: Var E. Lordahl, Long Grove, IL (US); Scott H. Koepsel, Winthrop Harbor, IL (US)

(73) Assignee: Var E. Lordahl, Long Grove, IL (US)

( * ) Notice: Subject to any disclaimer, the term of this patent is extended or adjusted under 35 U.S.C. 154(b) by 895 days.

(21) Appl. No.: 12/387,899

(22) Filed: May 9, 2009

(51) Int. Cl.
*E03D 1/35* (2006.01)
*E03D 1/34* (2006.01)
*E03D 11/00* (2006.01)

(52) U.S. Cl. ..... 4/393; 4/378; 4/417

(58) Field of Classification Search ..... 4/393, 324, 4/325, 417, 415, 378, 392
See application file for complete search history.

(56) References Cited

U.S. PATENT DOCUMENTS 2,320,132 A * 5/1943 Hoffmann ..... 4/369
3,959,828 A * 6/1976 Acevedo ..... 4/393
4,182,364 A * 1/1980 Gilbert et al. ..... 137/426
4,984,312 A * 1/1991 Pickerrell et al. ..... 4/378
5,754,986 A * 5/1998 Chien ..... 4/327
5,842,498 A * 12/1998 Locke et al. ..... 137/315.07
6,339,882 B1 * 1/2002 Goessling et al. ..... 29/890.127
7,634,821 B2 * 12/2009 Denzin ..... 4/378

* cited by examiner

*Primary Examiner* — Len Tran
*Assistant Examiner* — Chee-Chong Lee
(74) *Attorney, Agent, or Firm* — Katane McManus

(57) ABSTRACT

The universal flush valve system comprises an universal system connector accommodating seating thereon of both a flapper style flush valve assembly and a canister style flush valve assembly, as required; a plurality of toilet tank specific connector extensions, each of which are threadedly engageable to a bottom portion of the universal system connector and are used to suitably engage the universal system connector to a water flow port in a toilet tank by extending through the port and receiving a suitable cooperating connection element thereover; a sealing device for sealing the required flush valve assembly against the universal system connector; and a locking mechanism for locking the required flush valve assembly onto a top portion of the universal system connector, seating over the sealing device to produce a water tight engagement therebetween.

25 Claims, 4 Drawing Sheets

UNIVERSAL FLUSH VALVE SYSTEM

BACKGROUND OF THE INVENTION

The Toilet as a Part of a Central Sewage System

A toilet is part of a sewage system, it and the pipes it is connected to are a matched set which deliver sewage from inside a structure to a central municipal sewer or private septic system. For new construction and major remodeling, plumbing codes and sound installation practices in the United States and most countries cover issues regarding the size, material and pitch angles of the pipes that connect to the toilet so as to assure that the contents of what is flushed will run down hill all the way through the pipes out to this central municipal or private sewage system, otherwise pipes will clog up. The length and complexity of the pipes connecting the toilet to the sewage or septic systems vary greatly based on the size and location of buildings and municipalities. The proper installation of these pipes must be approved before walls and floors are installed because afterwards, from a practical standpoint, it is too late to change them.

Historically, building codes were based on the regulations and manufacturing practices that were used to produced the toilets. These older toilets were designed to operate using approximately 4 gallons per flush (GPF). In turn, this 4 gallon standard was the basis of regulations specifying the piping that connected the toilet to the central sewage system in order to make sure that what the toilet flushed would ultimately reach its destination in the central sewer system.

Recently, in the last 10 years or so, for ecological and political reasons a series of new national codes have been enacted which, overriding local ones, now require that new toilets must flush using less and less water. Older toilets used 4.5 gallons per flush (GPF), then 3.5 GPF, then 1.6 GPF and now 1.28 GPF. Current codes and practices also have been upgraded covering the sewage piping system so that both the toilet and the piping system work properly together, i.e., that the toilet properly flushes and that its contents do not clog pipes on the way to the central sewage system.

New toilets are usually installed during new construction or during the remodeling of a bathroom. As these new lower GPF toilets are installed for new construction, usually they work acceptably because the new piping systems they are attached to are designed to work with them. But often, when they are installed during remodeling they are attached to an older piping system designed for a 4 GPF flush and consequently then they often do not operate perfectly because of the small amount of water they use for the flush. When this occurs the toilet can flush well, but its contents clog in the pipes before they reach the central sewage system, often resulting in the need to clean out the pipes, which usually ends up being a messy, expensive, time consuming job.

Toilet Types—How they Work—What a Flush Valve does

Toilets are usually made from porcelain china, with a toilet bowl which mounts to the floor or hangs from the wall and a water delivery system which forces water into the bowl causing it to "flush". Toilets incorporate one of two types of water delivery systems, one, a flushometer valve, which is mounted on top of the bowl, which uses water pressure and timing mechanisms to deliver the water forcing the bowl to flush and two, a water storage tank which is usually mounted on top of the bowl, which delivers the water forcing the toilet bowl flush. There are two types of toilets using tanks, two piece models, where the tank and the bowl are made separately and assembled at the job site, and one piece models where the bowl and the tank are made as one integral piece at the factory.

On tank fed toilets the tank and the bowl connect and where they connect there is a round hole which allows the water from the tank to flow into the bowl which forces the bowl to flush. Until recently this hole has been standardized at approximately two inches in diameter. The flow of water through the hole is controlled by a seal mechanism called a flush valve. To flush a toilet you move a handle which opens the flush valve and allows the water from the tank to rush down into the bowl where its force and volume causes the toilet to flush.

A flush valve should not waste water but it must provide sufficient water to force the bowl to flush and enough to carry its contents all the way out into the sewer system—if not it creates clogged sewer lines. So, if a toilet is causing sewer line clogging, in addition to cleaning out the clog in the line, the flush valve should be changed to a model that functions properly within that plumbing system. If the flush valve fails to seal after a flush, its flush seal should be replaced and if that does not work, then the entire flush valve needs to be changed.

A flush valve is comprised of three basic parts: 1. a valve body which mounts between the tank and the bowl which has a waterway hole with a seal surface around its circumference; 2. a replaceable seal (flapper tank ball, round tank ball or canister with seal ring) that opens and closes against this hole's seal surface; 3. a means of mounting and sealing the valve body with seal in between the tank and bowl, so that before flushing the water remains stored in the tank.

To repair a leaky flush valve you change its replaceable seal, a simple non-labor intensive job, but if that does not fix the leak, usually the entire flush valve is changed, a heretofore labor intensive job. To replace an entire flush valve on two piece toilets you turn off the water supply, empty, then unbolt and separate the toilet tank from its bowl, then remove the old flush valve, and install the new one in reverse order. To change a flush valve in a one piece toilet, you must turn off the water supply, empty the tank, loosen and remove the existing flush valve and install the new one in reverse order. Historically, since flush valves were generally interchangeable you could find a replacement at most any store, buy one, install it and it would work.

Today, there are so many different non-interchangeable, non-adjustable flush valves that you can no longer just buy a replacement and expect it to work. This fact is the reason this new flush valve system was developed.

Problems Addressed by this New Flush Valve

For the Original Equipment Toilet Manufacturers (OEMs)

Toilet model selection has increased dramatically due to market demands. Often retailers want an exclusive design to protect them on advertised price guarantees and homeowners demand specific designer looks as home values increase, so the OEM can no longer offer just a few designs, they now offer new designs continually, and national codes now require that new toilets use much less water when flushing so as to save water and reduce sewage costs.

For economic and engineering reasons, OEM's usually keep bowl design changes to a minimum and make changes only on the tank half of the toilet. Although tank changes are less costly to make than bowl changes the costs are still significant, the largest expense often being expenses for the development of new plastic injection molds needed to make a new flush valve which will work in the new tank and allow the toilet to meet the new lower GPF government standards.

So, the OEMs have ongoing demands for less expensive ways to make more efficient flush valves needed to meet the new GPF requirements for all of their new style tanks.

For the Aftermarket Parts Distributor Specialists

Stores that sell toilets usually do not carry all of the parts necessary to fix all of the models of toilets that they sell. That function is filled by parts distributor specialists who often inventory over 200,000 items.

These specialists know that carrying all the exact factory replacements usually requires too much inventory to be profitable, and that selling only new identical OEM parts will not correct all problems, especially if more water is needed in a flush to deliver the bowl contents into the sewer line.

Ultimately, these specialists must sort out the confusion created by the design changes brought about by market demands and government regulations. In order to be successful they must keep track of what fits what and what can be interchanged so as to optimize the value of their product line. They are expected and want to have an inventory that will fix most any leaky toilet or clogged sewer line situation, the same day it is needed. To accomplish this they must have the correct inventory and be able to find what they need within their inventory.

So, aftermarket parts distributors need replacement flush valves that fit multiple model toilets, that deal with clogged sewer line issues, that are affordable to stock and that are easy to identify and find within their inventory.

For the Commercial Maintenance Market

The maintenance departments of apartment complexes, hotels/motels and institutions are routinely faced with changing toilet flush valves and fixing clogged sewer lines. They look at it as an ongoing expense, which they always want to reduce. The expense of changing a flush valve is primarily the high cost of the labor for changing it, as described above.

So, the maintenance markets need a flush valve that can be changed with less labor.

SUMMARY OF THE INVENTION

What this Flush Valve System Accomplishes

1. Allows an OEM to change his tank design more readily by not forcing him to make expensive flush valve molds for each new tank design. With this new invention method he need only tool up for a comparatively inexpensive adapter/coupler mold and use one of the standard, available flush valve tops which can be produced to meet the new exact lower GPF codes.
2. Allows an OEM to market his toilets claiming that they are better suited for the needs of the apartment building trades as they will be easier and cheaper to maintain because any future need to change a flush valve will only take the same low labor cost as changing a simple flapper tank ball, because the tank will not have to be removed on two piece toilets and the attachment devices and seal between the tank and bowl on one piece toilets will not have to be removed and replaced.
3. Allows an OEM to reduce his inventory for aftermarket repair needs.
4. Allows a replacement parts specialist to carry a comparatively few number of parts to cover most all repair applications to both old and new style toilets.
5. Allows a replacement parts specialist to reduce stock keeping units, his overall inventory costs and expand his offering by carrying only a couple of the basic flush valve styles (the flapper and canister types shown in the drawings), the expensive part, and a series of base couplers/adapters (the inexpensive parts) which enable him to cover most if not all toilet models from all toilet manufacturers.
6. Allows a replacement parts specialist to find his inventory due the interchangeability of this flush valves system because all adapter coupler bases interchange with all of the flush valve bodies in the system.
7. Allows a replacement parts specialist to offer raised flush valves so as to match many OEM models which incorporate this design, without having to carry the specific flush valves in inventory. The distributor merely has to carry one SKU, a riser which mounts quickly and easily on any of the base adapter/couplers. This riser allows all models of the mating flush valve tops be extended up to a high rise mount thereby meeting the flush demands of many newer toilet models.
8. Allows the installers of this flush valve to rotate the position of the flush valve after installation to avoid interference with the ballcock and flush handle in the new smaller tank configurations.
9. Allows the installers of this flush valve to adjust the overflow tube height so as to increase the flush valve water flow to make sure the contents of the toilet flush reach the sewer lines so as to alleviate clogged sewer line situations.
10. Allows the installers of this flush valve to carry to the job site a series of inexpensive adapters and a couple of flush valves to cover most all repair situations.
11. Allow owners of older toilets with a 2" flush valve to convert it to the new larger flush vale size and height to install this new jumbo flush valve by installing it with its "2×4" adapter thereby simulating the benefits of the newer toilets with the larger holed flush valve which often times reduces GPF of older 2" toilet models.
12. Allows for its manufacturer to merely make inexpensive adapters to fit various toilets, and the adapters will work/fit a small number of flush valves that can be assembled in a variety of combinations which provides market coverage to the OEMs—who need to meet exact government codes and market coverage to the tradesmen who must make a new toilet work on an old piping system.

DESCRIPTION OF THE PREFERRED EMBODIMENTS

Figure 1:
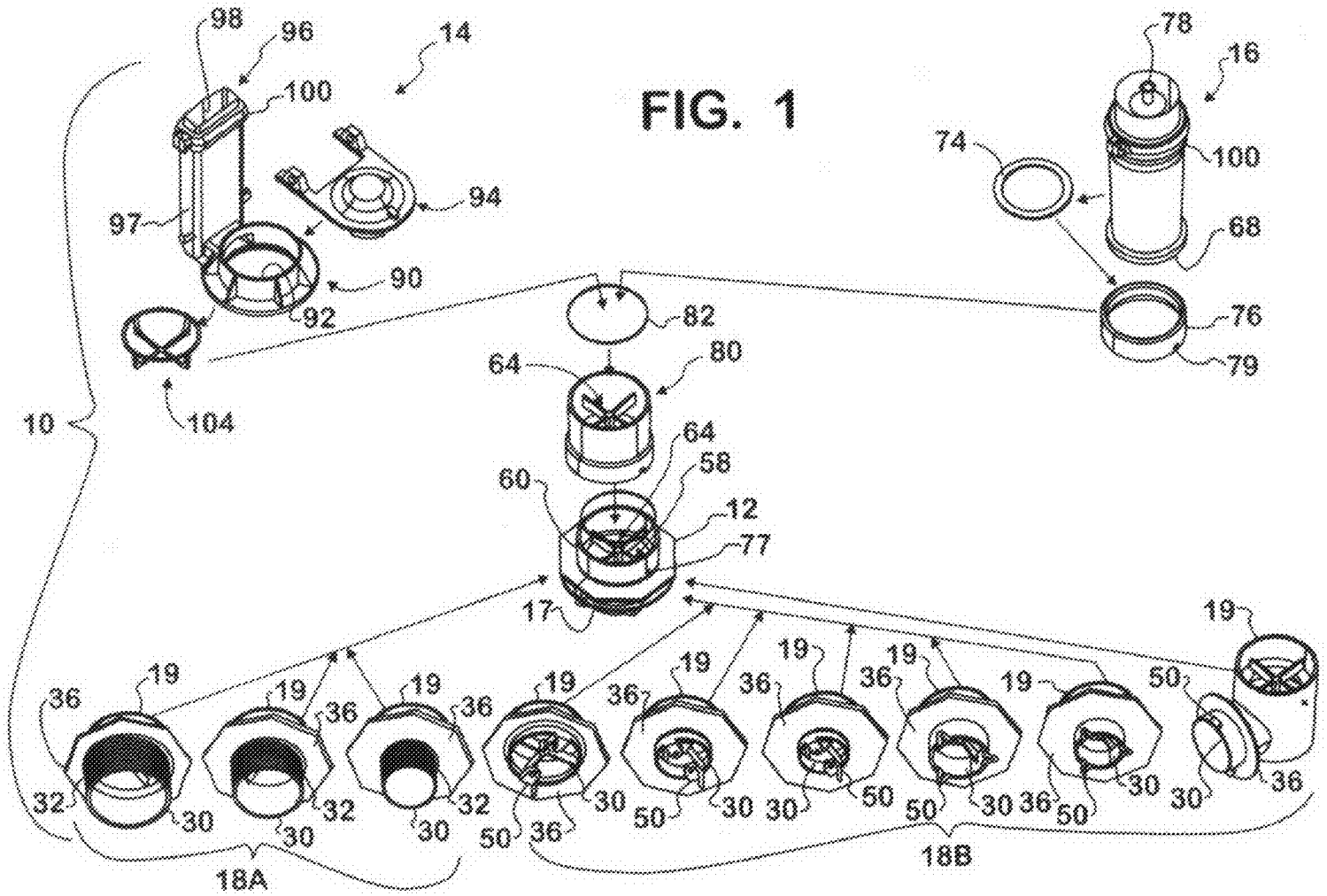
FIG. 1 is an exploded perspective view of the various structures of the universal flush valve system of the present invention, showing all potential interconnections therebetween.

As best illustrated in FIG. 1, an exploded view of exemplary structures used to create the flush valve system of the present invention, generally identified by the reference numeral 10, it will be seen that the operative structure thereof is a connector 12 which is suited to engage thereupon, in watertight manner, either a flapper type flush valve assembly 14 or a cylinder type flush valve assembly 16.

Connectable to an underside area 17 of the connector 12 are a particular one of a plurality of connector extensions 18, as a group, some of which, labeled 18A, as a group, suited for use with one of various embodiments of a two piece toilet (not shown) and others of which, labeled 18B, as a group, are suited for use with one of various embodiments of a one piece toilet (not shown).

The purpose of the connector extensions 18, as a whole, is to engage a first or top end 19 thereof to an interior neck 22 within the underside area 17 of the connector 12. Inasmuch as the connector 12 has dimensions that do not vary, the first end 19 of each connector extension 18, within the group as a whole, is substantially identical. Engagement between the top end 19 of a desired extension 18 to the interior neck 22 of the underside area 17 of the connector 12 is created by any suitable form of permanent attachment, such as by gluing or sonic welding, as examples.

Figure 2A:
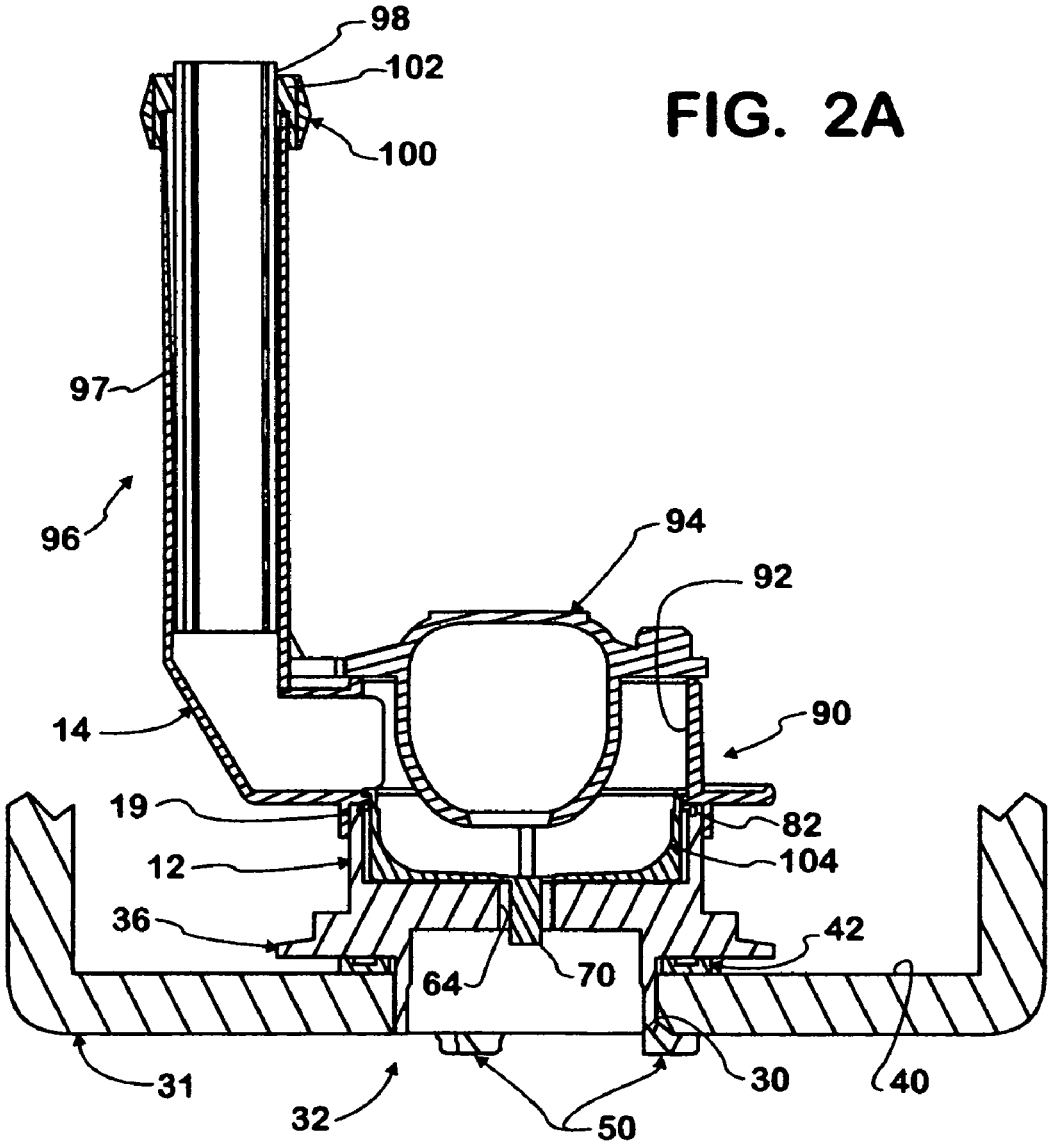
FIG. 2A is a cross sectional view through an exemplary embodiment of the system of FIG. 1 shown for use in a tank of a one piece toilet.
Figure 2B:
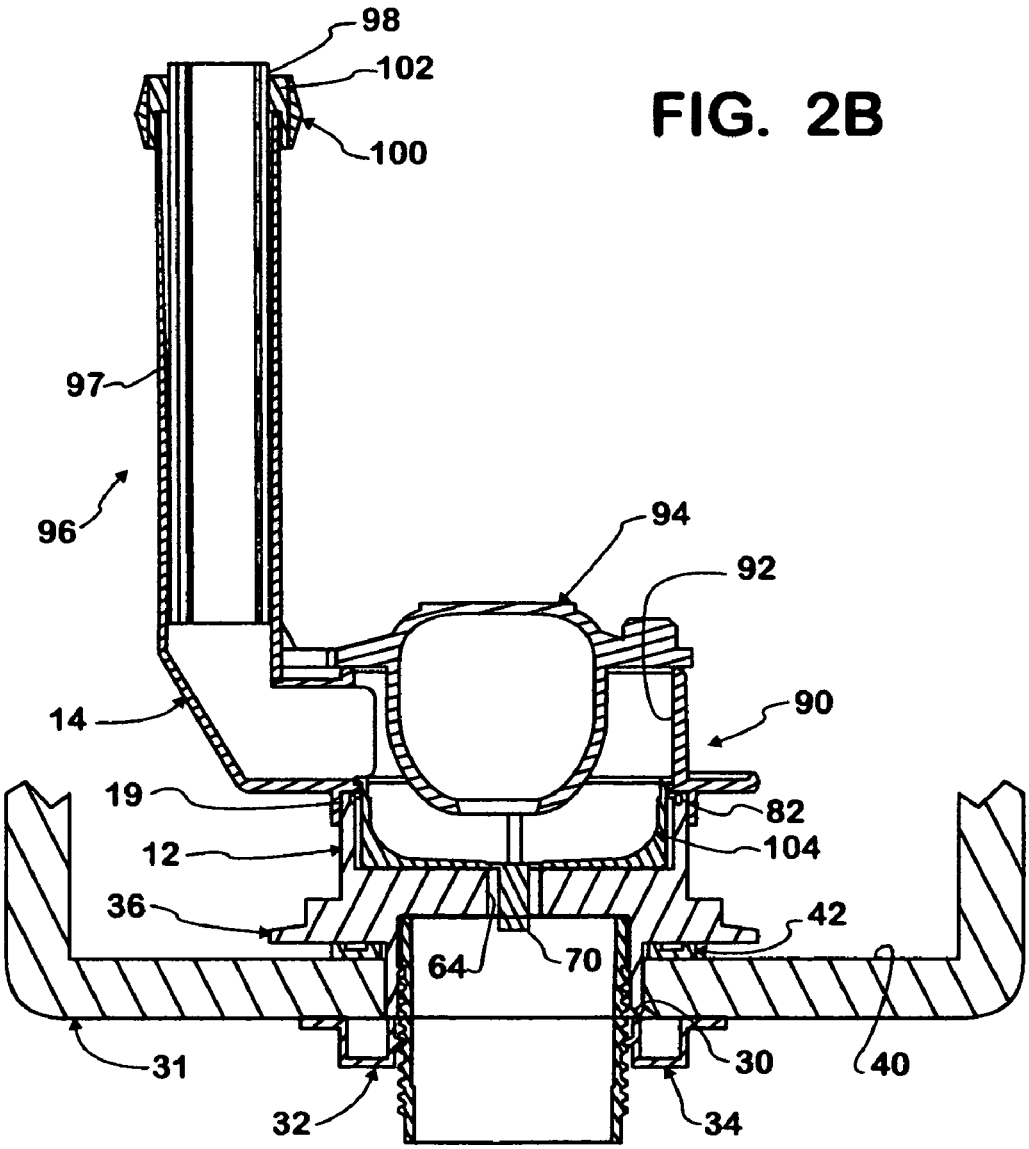
FIG. 2B is a cross sectional view through another exemplary embodiment of the system of FIG. 1.
Figure 3:
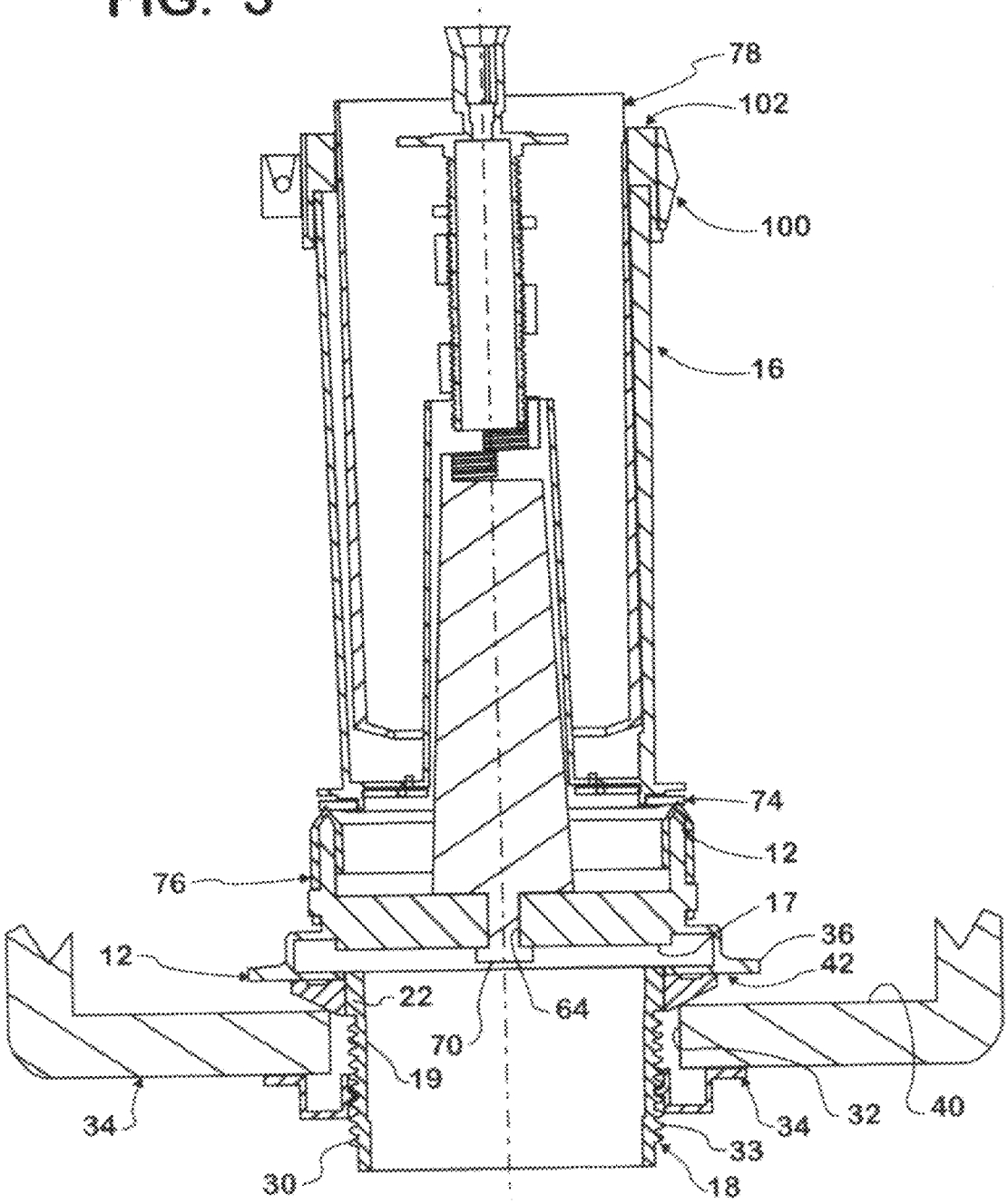
FIG. 3 is a cross sectional view through an exemplary embodiment of the system of FIG. 1 shown for use in a tank of a two piece toilet.

An opposite end area 30 of each exemplary connector extension 18, illustrated, varies in diameter to accommodate an inner diameter of a water flow opening 32 of a corresponding toilet tank 31 (FIGS. 2 and 3). The diameters of such water flow openings 32, in various embodiments, can range anywhere from approximately 2 inches in diameter to over 3 inches in diameter, depending on the particular model of toilet being dealt with. It will be understood that each area of joining throughout the system 10 is preferably filled with an appropriately configured seal such as an O-ring even though each one may not be separately identified herein. Further, between first or top end 19 and opposite end area 30 of each connector extension 18 is found a sealing flange 36, which seals against a tank wall defining the water flow opening 32 therein. In most embodiments such wall is a bottom wall of the tank, however there are also embodiments that may use a vertical wall for engagement, so definitions of the wall utilized herein should not be construed as limiting.

Further, it will be seen that the opposite end area 30 of each extension 18A, for use in the tank 31 of a two piece toilet, is provided with a threaded outer surface 33, to which a suitable connector element 34, such as a nut 34, is threadedly engaged after the opposite end area 30 is passed through the water flow opening 32 from within the interior of the tank 31, to secure flange 36 over the opening 32. To assure water tight engagement of the connector against the surrounding wall 40 of the opening 32, a seal, such as an O-ring 42 is engaged about the connector extension 18, within the tank 31, and seals between the wall 40 and the flange 36 when the system 10 is suitably secured in place.

Turning to the opposite end area 30 of each extension 18B, for use in the tank 31 of a one piece toilet, it will be seen that the area 30 is not threaded, but has integral locking lugs 50 provided thereon, or receptacles for a different suitable connector element 34, such as a screw on locking nut 34, is received to lock the connector 12 into position against the tank wall 40, again as described above.

The provision of such a plurality of various connector extensions 18, in combination with the connector 12 itself, creates a minimal number of structures to accommodate replacement of virtually any flush valve system 10, rather than the numerous structures previously necessary, as described above, to accommodate such replacement, making the flush valve system 10 essentially universal.

Further, when dealing with modern day, low flush toilets, it will be understood that the connector 12 has a central opening 58 therein of a fairly large diameter, of approximately 3-4 inches, and typically drains into a smaller water flow opening 32, creating a venturi effect therethrough which improves the flushing capability of such low flush toilet, a known problem in the art.

Turning now to the cylinder type flush valve assembly 16, it is adapted to seat upon an upper surface 60 of the connector 12 and is engageable thereto by means of a keylock engagement, the connector 12 having a keyhole element 64 centered within the opening 58, and a bottom surface 68 of the cylinder or cartridge type flush valve 16 has a key element 70 thereon which passes through an opening 72 in the keyhole element 64 and the flush valve 16 is then twisted, locking the structures together. For assured water tight fit, again, an O-ring 74 and seal 76 are seated between the flush valve 16 and the connector 12 prior to engaging the structures together. It will be seen that a nub 77 is provided on the outer cylindrical surface of the connector 12 and a cooperating slot 79 is provided on the seal 76, with the nub 77 sliding up into the slot 79, and being locked into the slot 79, which slot 79 is configured in the preferred embodiment as an upside down L, by twisting of the seal 76 relative to the connector 12. Also, the upper edge 81 of connector 12 is configured to serve as a sealing surface 81 for the cartridge type flush valve 16 and, if the sealing surface 81 should become damaged, seating of the seal 76 thereover provides an easy fix for any such damage.

It will be understood that the cylinder type flush valve 16 is provided as a complete unit 16, and incorporates a telescopic overflow tube 78, so that the amount of water utilized per flush can be varied as necessary. Further, to add for a greater amount of water utilized per flush, it is proposed herein to provide an optional riser 80 which can be engaged, in like manner, between the flush valve 16 and the connector 12, the riser 80 also incorporating a keyhole element 64 at a first end thereof and a key element 70 at an opposite end thereof, to create engageability between the structures in water tight manner, also preferably with an O-ring 82 seated therebetween. Such riser 80 may be used to accommodate toilet tanks 31 of taller dimension, and adds to the amount of water available per flush, increasing flushing capability.

Turning now to the flapper type flush valve assembly 14, it will be seen to comprise a base 90 which is engageable in like manner to the connector 12 as the cylinder flush valve 14. The base 90 incorporates a flapper seat 92 over which a flapper 94 seats, in known fashion. Also provided is an overflow tube 96 which is substantially rectangular in cross section and is also telescopic. A bottom portion 97 of the overflow tube has an extendible portion 98 therewithin, which, when extended, again adds to the amount of water available per flush. The two pieces of the overflow tube 96 are engaged together by a releasable clamp 100 with a seal member 102 being positioned therewithin to again assure a water tight engagement therebetween. It will be understood that the flapper 94 is maintained engaged to the bottom portion 97 of the overflow tube 96, in known manner.

The flapper type flush valve assembly 14 is engaged to the connector 12 in a manner similar to that in which the cylinder type flush valve 16 is engaged thereto, except that here, a snap on key ring 104 is provided for engaging the base 90 to the connector 12. The ring 104 in the preferred embodiment snaps into a corresponding groove in the base 90. It has not, in a preferred embodiment, been found advantageous to use the optional riser 80 with the canister type flush valve 16, but this should not be construed as limiting With the significantly few structures described herein, when joined as necessitated by the particular toilet with which the universal flush valve system 10 is to be used, substantially all existing toilet embodiments can be accommodated, making the system 10 not only time but material saving as well. Then structures may be engaged as necessary at the point of sale, or may be purchased as a kit, or separately and engaged at the point of use. There is no limitation on how the structures may be presented for consumption.

Further, the flush valve assemblies 14 and 16 may be removed and replaced, as necessary, without taking the entire system 10 apart.

Still further, the flush valve assemblies 14 and 16 are now provided with rotatability, if required, so as not to interfere with, for example, flush handle action.

As described above, the universal flush valve system 10 of the present invention provides a number of advantages, some of which have been described above and others of which are inherent in the invention. Also, modifications may be proposed to the system 10 without departing from the teachings herein. Accordingly the scope of the invention is only to be limited as necessitated by the accompanying claims.

The invention claimed is:

1. An universal flush valve system comprising:

an universal system connector accommodating seating thereon of either a flapper style flush valve assembly or a canister style flush valve assembly, as required by a particular embodiment of a toilet tank of either a one or two piece toilet within which the flush valve system is utilized;

a toilet tank specific connector extension which is capable of being permanently mechanically engaged to a bottom portion of said universal system connector and used to suitably engage the universal system connector to a corresponding water flow opening in the particular embodiment of toilet tank by extending through the opening and receiving a suitable cooperating connection element thereover;

a sealing device for sealing the flush valve assembly against the universal system connector; and a locking mechanism for locking the flush valve assembly onto a top portion of the universal system connector, seating over the sealing device to produce a water tight engagement therebetween.

2. The system of claim 1 wherein the flapper style flush valve assembly incorporates a base with a flapper seating on a flapper seat of the base and an overflow tube, the flapper engaging to locking tabs for the flapper provided on the overflow tube.

3. The system of claim 2 wherein said overflow tube is telescopic.

4. The system of claim 2 wherein said overflow tube is substantially rectangular in cross section.

5. The system of claim 2 wherein the overflow tube comprises two sections, one an outer, lower section and another a telescopic inner, upper section.

6. The system of claim 5 wherein a releasable clamp is used to maintain the two sections of the overflow tube at a desired height.

7. The system of claim 6 wherein a seal is seated around the point of juncture between the two overflow tube sections, and the clamp is applied therearound.

8. The system of claim 1 wherein the canister style flush valve assembly is preassembled and incorporates an overflow tube.

9. The system of claim 8 wherein said overflow tube is telescopic.

10. The system of claim 8 further including a replaceable seal member for repairing a damaged or corroded sealing surface on a top rim of the connector.

11. The system of claim 1 wherein a riser to elevate the flush valve assembly above the universal assembly connector is engageable between the universal assembly connector and the flush valve assembly.

12. The system of claim 11 wherein an O-ring is positioned between the riser and the universal assembly connector to provide a seal therebetween.

13. The system of claim 1 wherein the flush valve assembly is engaged onto the connector by a keylock type system.

14. The system of claim 1 including an optional riser positionable between the cylinder type flush valve assembly and the connector.

15. The system of claim 1 wherein the optional riser is engaged to both the connector and the cylinder type flush valve assembly by a keylock type system.

16. The system of claim 1 wherein a lower portion of the connector extension is threaded.

17. The system of claim 16 wherein a nut is threadedly engaged over the lower threaded portion of the connector extension.

18. The system of claim 1 wherein a lower portion of the connector extension is not threaded but has locking lugs thereon.

19. The system of claim 18 wherein a locking ring that twist locks onto the connector extension at a position above the locking lugs is provided.

20. The system of claim 1 wherein a diameter of an upper portion of each connector extension is identical.

21. The system of claim 1 wherein meter of a lower portion of the connector has a diameter which accommodates passage through the water flow opening of a toilet tank within which the system is installed.

22. The system of claim 1 wherein a diameter of the universal connector is at least 2 inches.

23. The system of claim 1 wherein a diameter of the universal connector is up to 4 inches.

24. The system of claim 1 wherein a diameter of the water flow opening of a toilet tank is at least 2 inches.

25. The system of claim 2 wherein the flush valve assembly is rotatable relative to the base to eliminate interference with other structures within the tank.

* * * * *